US009394802B2

(12) United States Patent
Warren et al.

(10) Patent No.: US 9,394,802 B2
(45) Date of Patent: Jul. 19, 2016

(54) SENSOR HOOP STORAGE AND TRANSPORT APPARATUS

(71) Applicant: United Technologies Corporation, Hartford, CT (US)

(72) Inventors: Eli C. Warren, Wethersfield, CT (US); Erik W. Hatton, Atkinson, NH (US); Erik D. Rice, Lebanon, CT (US); Corey A. Benoit, Uncasville, CT (US)

(73) Assignee: United Technologies Corporation, Farmington, CT (US)

( * ) Notice: Subject to any disclaimer, the term of this patent is extended or adjusted under 35 U.S.C. 154(b) by 64 days.

(21) Appl. No.: 14/096,627

(22) Filed: Dec. 4, 2013

(65) Prior Publication Data

US 2014/0252183 A1 Sep. 11, 2014

Related U.S. Application Data

(60) Provisional application No. 61/775,654, filed on Mar. 10, 2013.

(51) Int. Cl.

| | |
|---|---|
| ***F16M 11/10*** | (2006.01) |
| ***F16M 11/16*** | (2006.01) |
| ***B64D 27/00*** | (2006.01) |
| ***F01D 11/20*** | (2006.01) |
| ***F01D 17/02*** | (2006.01) |
| ***F01D 17/20*** | (2006.01) |
| ***F01D 21/00*** | (2006.01) |
| ***F01D 21/04*** | (2006.01) |
| *F01D 25/28* | (2006.01) |

(52) U.S. Cl.

CPC ..... *F01D 11/20* (2013.01); *F01D 17/02* (2013.01); *F01D 17/20* (2013.01); *F01D 21/003* (2013.01); *F01D 21/04* (2013.01); *F01D 25/285* (2013.01); *F01D 25/28* (2013.01)

(58) Field of Classification Search

CPC ..... F01D 25/28; F01D 25/285; F01D 17/20; F02K 3/00; F16M 11/16

USPC ..... 248/163.1, 554, 555, 676, 677; 60/173.6; 244/54; 269/287, 296

See application file for complete search history.

(56) References Cited

U.S. PATENT DOCUMENTS

| | | | | |
|---|---|---|---|---|
| 4,202,539 | A * | 5/1980 | Polastri et al. | 269/70 |
| 6,417,578 | B1 * | 7/2002 | Chapman et al. | 290/44 |
| 6,487,845 | B1 * | 12/2002 | Modglin et al. | 60/226.2 |
| 6,712,516 | B1 * | 3/2004 | Giberson | 384/215 |
| 8,172,175 | B2 * | 5/2012 | Lair | 244/110 B |
| 8,287,180 | B2 * | 10/2012 | Kolar et al. | 366/347 |
| 2012/0324907 | A1 * | 12/2012 | Waldron et al. | 248/554 |
| 2014/0252183 | A1 * | 9/2014 | Warren et al. | 248/163.1 |

* cited by examiner

*Primary Examiner* — Tan Le

(74) *Attorney, Agent, or Firm* — Bachman & LaPointe, P.C.

(57) ABSTRACT

A hoop support device (202) supports a hoop assembly (100). The hoop assembly comprises a structural hoop (102) and a plurality of wires. The hoop support device comprises a pedestal (206) having a mounting feature (224, 226) for mounting the hoop and a cover (208 pivotally mounted or mountable to the pedestal for rotation about a pivot axis (510). The cover has at least a lateral portion (250, 252) and a peripheral portion (254) for enclosing at least one said wire in an installed/closed condition.

18 Claims, 9 Drawing Sheets

SENSOR HOOP STORAGE AND TRANSPORT APPARATUS

CROSS-REFERENCE TO RELATED APPLICATION

Benefit is claimed of U.S. Patent Application Ser. No. 61/775,654, filed Mar. 10, 2013, and entitled "Sensor Hoop Storage and Transport Apparatus", the disclosure of which is incorporated by reference herein in its entirety as if set forth at length.

BACKGROUND

The disclosure relates to turbine engines. More particularly, the disclosure relates to transport and storage of wired hoop structures.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

In an exemplary gas turbine engine, there may be a number of hoop structures to which sensors are mounted. One example involves sensors used to measure blade to case clearance. The hoop structure may form an outer air seal circumscribing a stage of blades.

FIG. 2 shows an exemplary hoop assembly 100 comprising a structural hoop member 102 having an inner diameter (ID) face 104 in close proximity to tips 106 of blades 108 of the associated blade stage. The exemplary ID face 104 bears a rub coating 110 for interfacing with the blades. The exemplary hoop bears a circumferential array of sensors 112. The exemplary sensors 112 are capacitive sensors used by a data acquisition system (not shown) to measure capacitance between the sensors and the passing blades so as to, in turn, determine radial clearance between the blade tips and the sensors (and thus the ID face 104). In the exemplary embodiment, each sensor 112 is mounted in an associated mounting aperture 114 of the structural hoop. The exemplary apertures 114 are radial through-apertures in an inner diameter (ID) band portion (band) 116 of the structural hoop whose inner diameter (ID) surface is the face 104. The band also has an outer diameter (OD) surface 117 and a first end 118 and a second end 119.

Various structural hoop cross-sectional geometries are possible. The exemplary structural hoop has a flange 120 protruding radially outward from an inboard junction 121 with the band. The exemplary flange 120 has a circumferential array of mounting holes 122 extending between first and second faces 123 and 124. The holes 122 may be used to mount to an adjacent flange of an adjacent hoop or other structure. In the particular exemplary structural hoop, there is an outer/outboard band portion (band) 130 extending axially from a junction 132 the outboard periphery 126 of the flange 120 to a junction 134 with the inboard periphery 142 of a second flange 140. The flange 140 has an outer/outboard periphery 144 and first and second opposite faces 146 and 148. In this embodiment, an array of holes 150 between the faces 146 and 148 of the second flange may be used to mount to an outer case support (not shown). Myriad other physical geometries of hoop are possible.

There may be one or more of several fragile features associated with the sensors 112. FIGS. 3 and 5 show the sensor elements 160 themselves. Second, FIG. 5 shows the sensor element held by a ceramic insulator 162 in a sensor body or housing 164 (schematically shown with internal wiring omitted). Opposite the sensor element 160, the housing carries a plug-like cap 166 which, in turn, carries wiring 168. FIG. 5A shows a braze 170 between the wiring (wire lead) 168 and an aperture 172 of the cap 166. The braze 170 and the wire lead 168 itself are potentially fragile. The exemplary wire lead 168 is a single wire extending off for length and formed in a loop for storage/transport. On installation into the associated engine, the wire lead may be extended and connected to the relevant wiring harness. Alternative configurations may involve multi-wire bundles and the like.

SUMMARY

One aspect of the disclosure involves a hoop support device for supporting a hoop assembly. The hoop assembly comprises a structural hoop and a plurality of wires. The hoop support device comprises a pedestal having a mounting feature for mounting the hoop and a cover pivotally mounted or mountable to the pedestal for rotation about a pivot axis. The cover has at least a lateral portion and a peripheral portion for enclosing at least one said wire in an installed/closed condition.

In one or more embodiments of any of the foregoing embodiments, the pedestal comprises a base having a plurality of mounting holes and a web extending upward from the base and bearing the attachment feature and a feature for said pivotal mounting of the cover.

In one or more embodiments of any of the foregoing embodiments, the mounting feature comprises a distal boss and a threaded hole in the boss.

In one or more embodiments of any of the foregoing embodiments, the cover and the pedestal are non-metallic.

In one or more embodiments of any of the foregoing embodiments, the cover comprises said lateral portion being a first lateral portion, a second lateral portion, and the peripheral portion joining the first and second lateral portions.

In one or more embodiments of any of the foregoing embodiments, the cover and/or the pedestal comprises means for selectively locking the cover in a plurality of orientations about the pivot axis.

In one or more embodiments of any of the foregoing embodiments, the hoop support device is in combination with the hoop assembly. The structural hoop is secured at the mounting feature. The cover covers at least one associated said wire bundle.

In one or more embodiments of any of the foregoing embodiments, at least one tie-wrap secures the associated wire bundle to the cover.

In one or more embodiments of any of the foregoing embodiments, the combination includes a plurality of said hoop support devices.

In one or more embodiments of any of the foregoing embodiments, the combination further comprises a base to which the pedestals are mounted and a container containing the base, hoop support devices, and hoop assembly.

In one or more embodiments of any of the foregoing embodiments, the hoop assembly comprises the structural hoop having: an inner diameter (ID) band; a rub coating along an inner diameter (ID) face of the ID band; a plurality of apertures in the ID band; and at least one flange protruding radially outward from the ID band. The hoop assembly further comprises a plurality of sensors mounted in respective ones of the apertures and a plurality of said wires, each respectively associated with an associated said sensor.

In one or more embodiments of any of the foregoing embodiments, a method for using the hoop support device comprises mounting the structural hoop and rotating the cover.

In one or more embodiments of any of the foregoing embodiments, the mounting comprises inserting a screw through a hole in the structural hoop and screwing to the pedestal and the rotating comprises rotating into the installed/closed condition from an installed/open condition and locking.

In one or more embodiments of any of the foregoing embodiments, there are a plurality of said hoop support devices and, for each said hoop support device, the method comprises mounting the structural hoop and rotating the cover.

In one or more embodiments of any of the foregoing embodiments, the method further comprises, while the structural hoop is mounted to the pedestal, testing sensors of the hoop assembly.

In one or more embodiments of any of the foregoing embodiments, the method further comprises, while the structural hoop is mounted to the pedestal, placing the hoop in a container and shipping the container.

In one or more embodiments of any of the foregoing embodiments, the rotating comprises rotating into the installed/closed condition from an installed/open condition and the method further comprises rotating the cover back from the installed/closed condition to the installed/open condition and dismounting the structural hoop from the pedestal.

In one or more embodiments of any of the foregoing embodiments, the method further comprises installing the cover to the pedestal after the mounting and before the rotating.

In one or more embodiments of any of the foregoing embodiments, the hoop assembly is a first hoop assembly and the method further comprises dismounting the structural hoop from the pedestal and mounting a structural hoop of a second hoop assembly to the pedestal, the second hoop assembly differing in size from the first hoop assembly.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
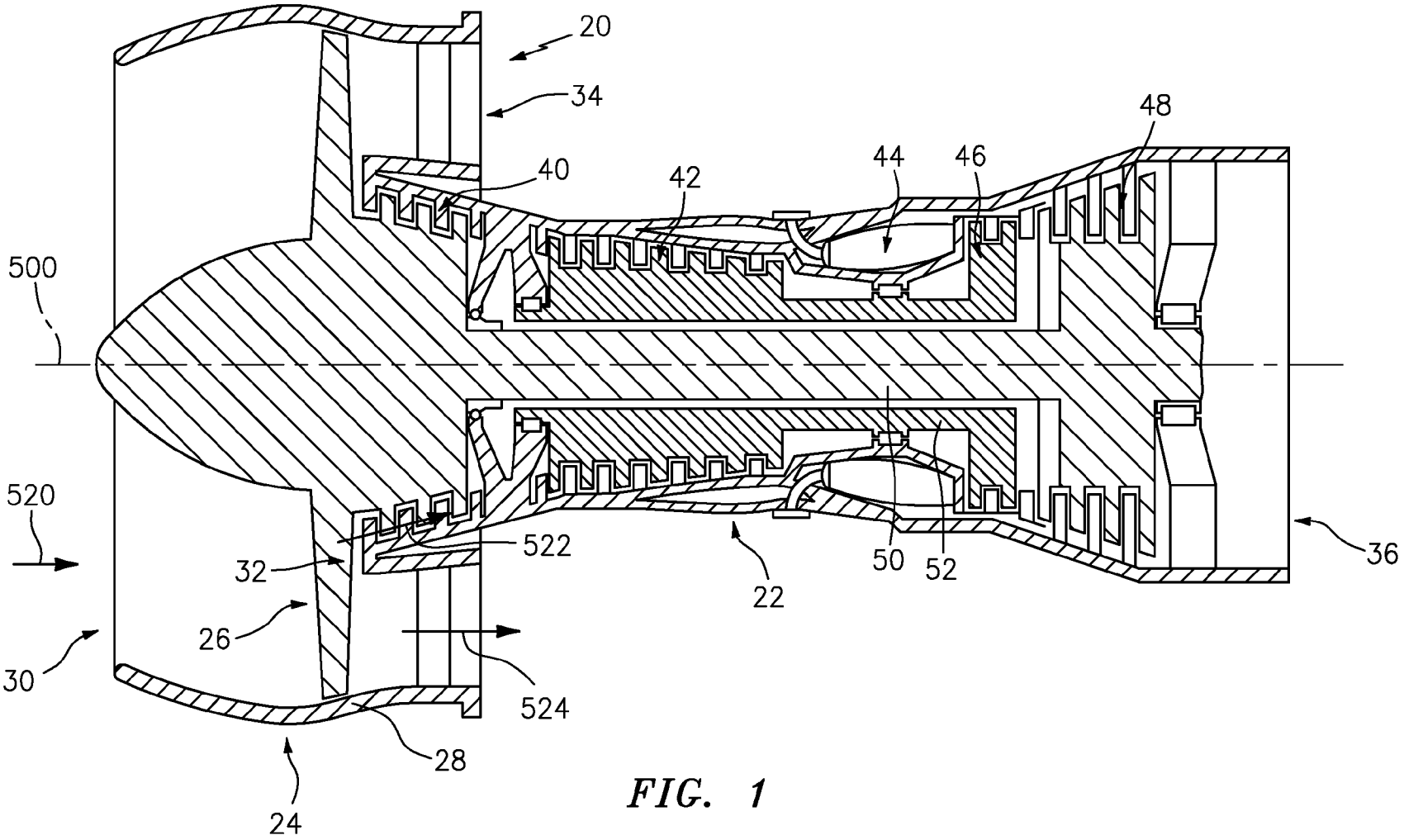
FIG. 1 is a partially schematic sectional view of a turbofan engine.
Figure 2:
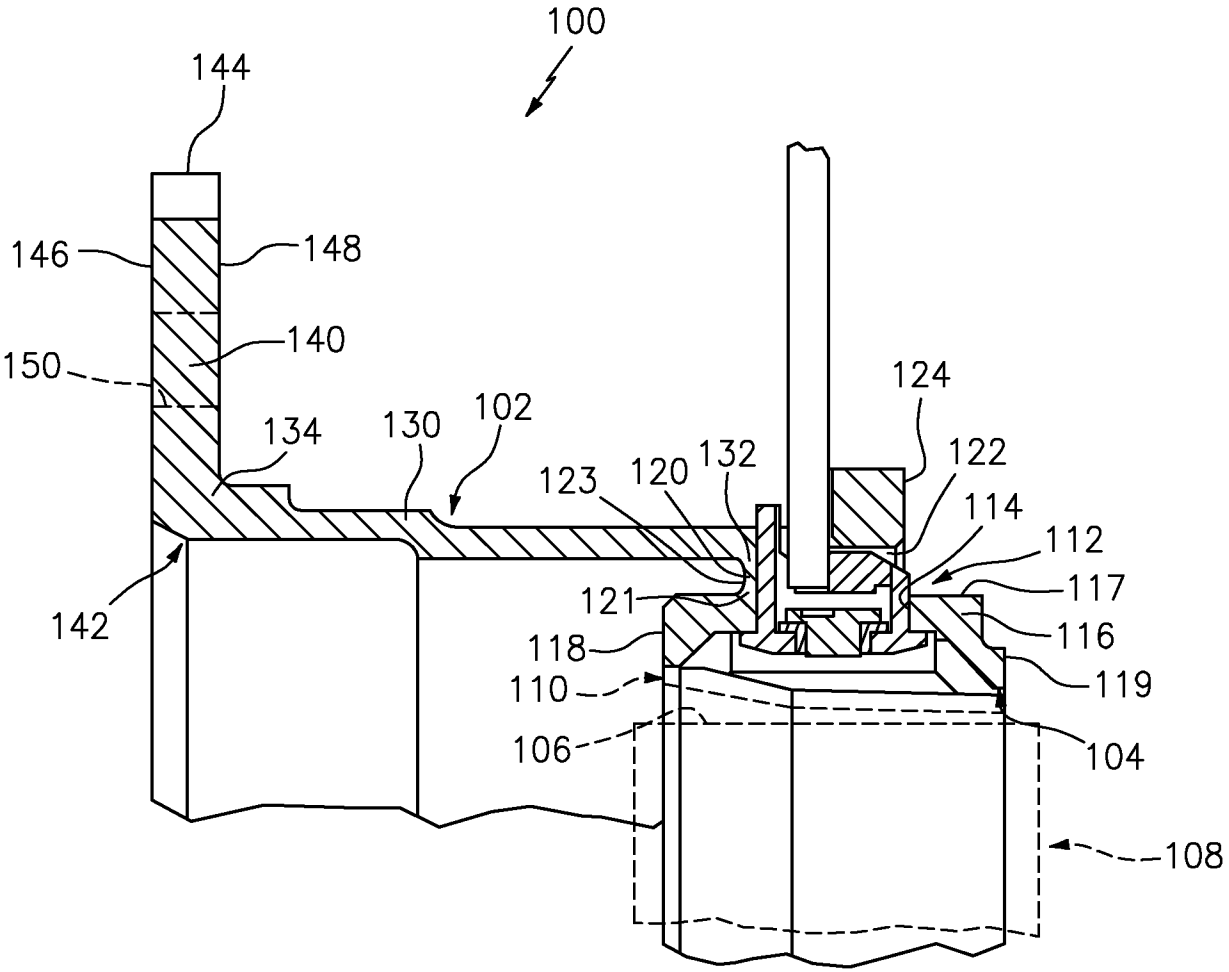
FIG. 2 is a sectional view of a hoop of the engine of FIG. 1.
Figure 5A:
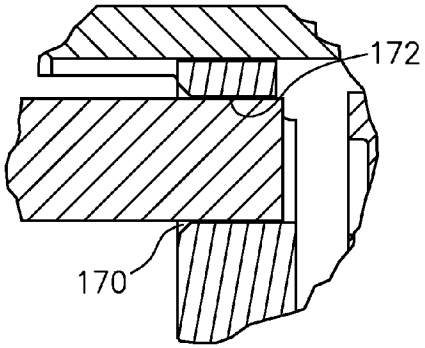
FIG. 5A is an enlarged view of a wire mounting of the sensor unit of FIG. 5.
Figure 5:
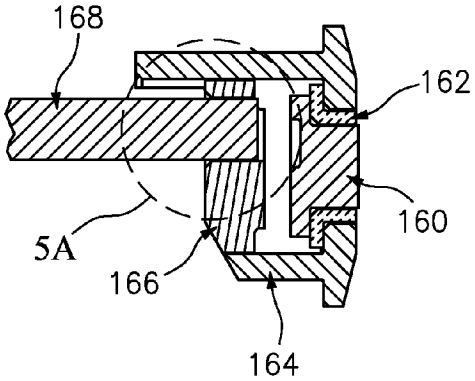
FIG. 5 is a sectional view of the sensor unit taken along line 5-5 of FIG. 4.
Figure 3:
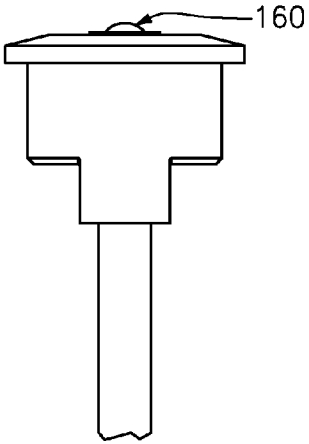
FIG. 3 is a top view of a sensor unit for the hoop of FIG. 2.
Figure 4:
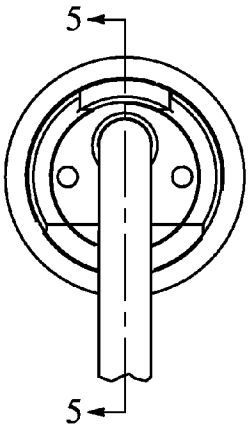
FIG. 4 is an outboard end view of the sensor unit.
Figure 6A:
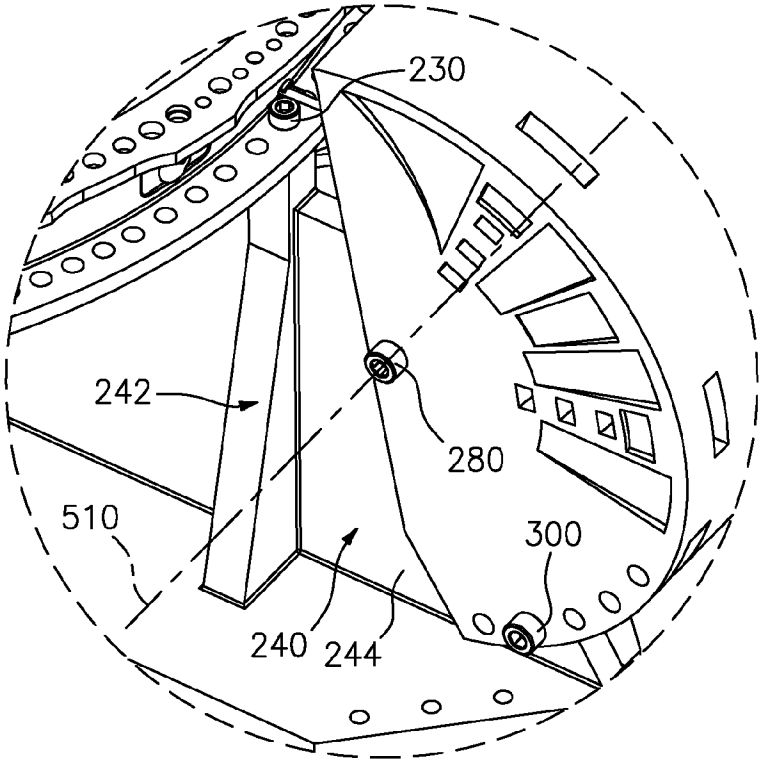
FIG. 6A is an isolated view of a hoop support device of the system of FIG. 6.
Figure 6:
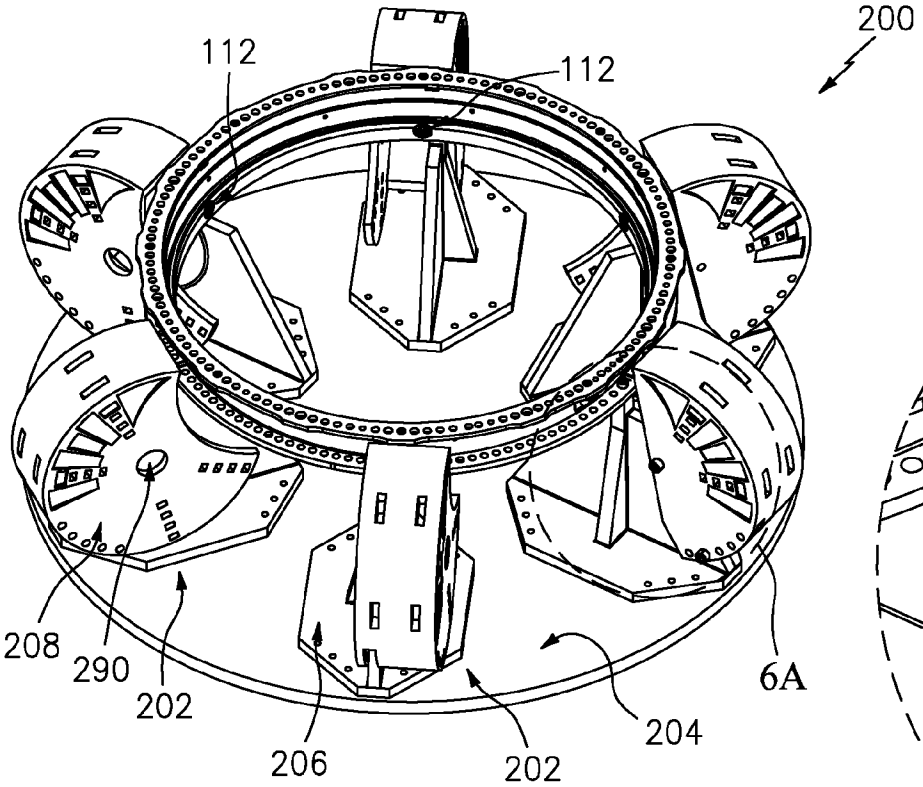
FIG. 6 is a view of the sensor hoop in a transport and storage fixture.
Figure 7A:
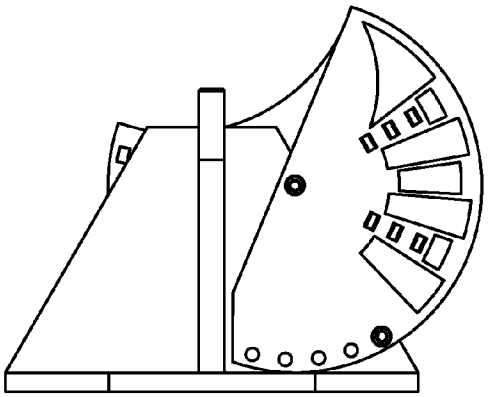
FIGS. 7A-E are sequential views of rotation of a cover of the device of FIG. 6A.
Figure 7B:
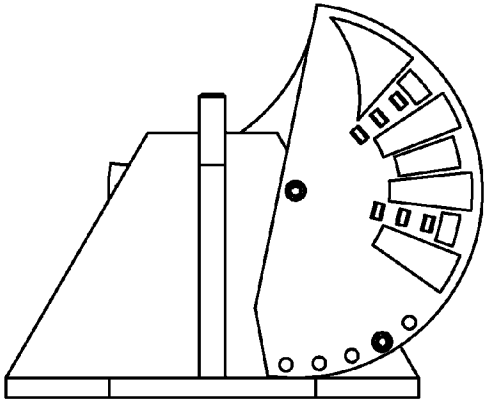
Figure 7C:
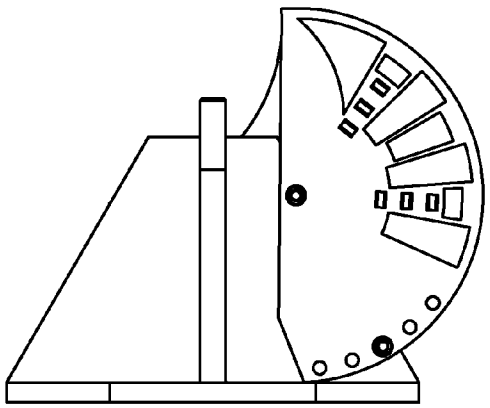
Figure 7D:
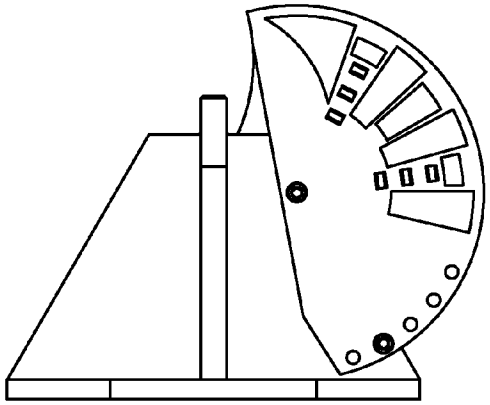
Figure 7E:
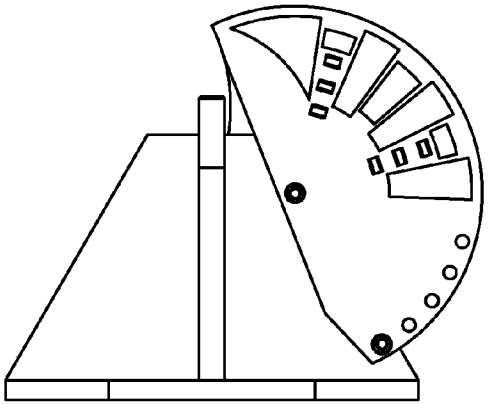

A system may be provided to support the hoop assembly during one or more stages of transport, storage, testing, and the like. FIG. 6 shows an exemplary system 200 for supporting the hoop assembly. The exemplary system is modular comprising a number of individual hoop support devices 202. The devices 202 may be secured to a base 204 (e.g., as discussed below).

The exemplary system associates a different device 202 with each of the sensors 112 (or potentially groups of sensors) to be protected. In the exemplary six-sensor hoop, this involves six devices evenly circumferentially spaced.

Each exemplary device 202 comprises a pedestal or stand 206 for mounting the structural hoop and a cover 208 for at least partially enclosing the associated wiring. The cover has one or more installed conditions mounted to the pedestal and may have removed/uninstalled conditions, depending upon the implementation. The exemplary cover is pivotally mounted or mountable to the pedestal for rotation about a pivot axis 510 (FIG. 6A) of the associated device 202 between a plurality of installed conditions (e.g., from an installed but open condition (or relatively open) to an installed but closed condition (or relatively closed)). In such installed/closed condition, the cover may provide a greater degree of protection/covering to the associated wiring than in the installed/open condition.

FIGS. 7A-7E show a series of stages of rotation between relatively open and relatively closed conditions.

Figure 8:
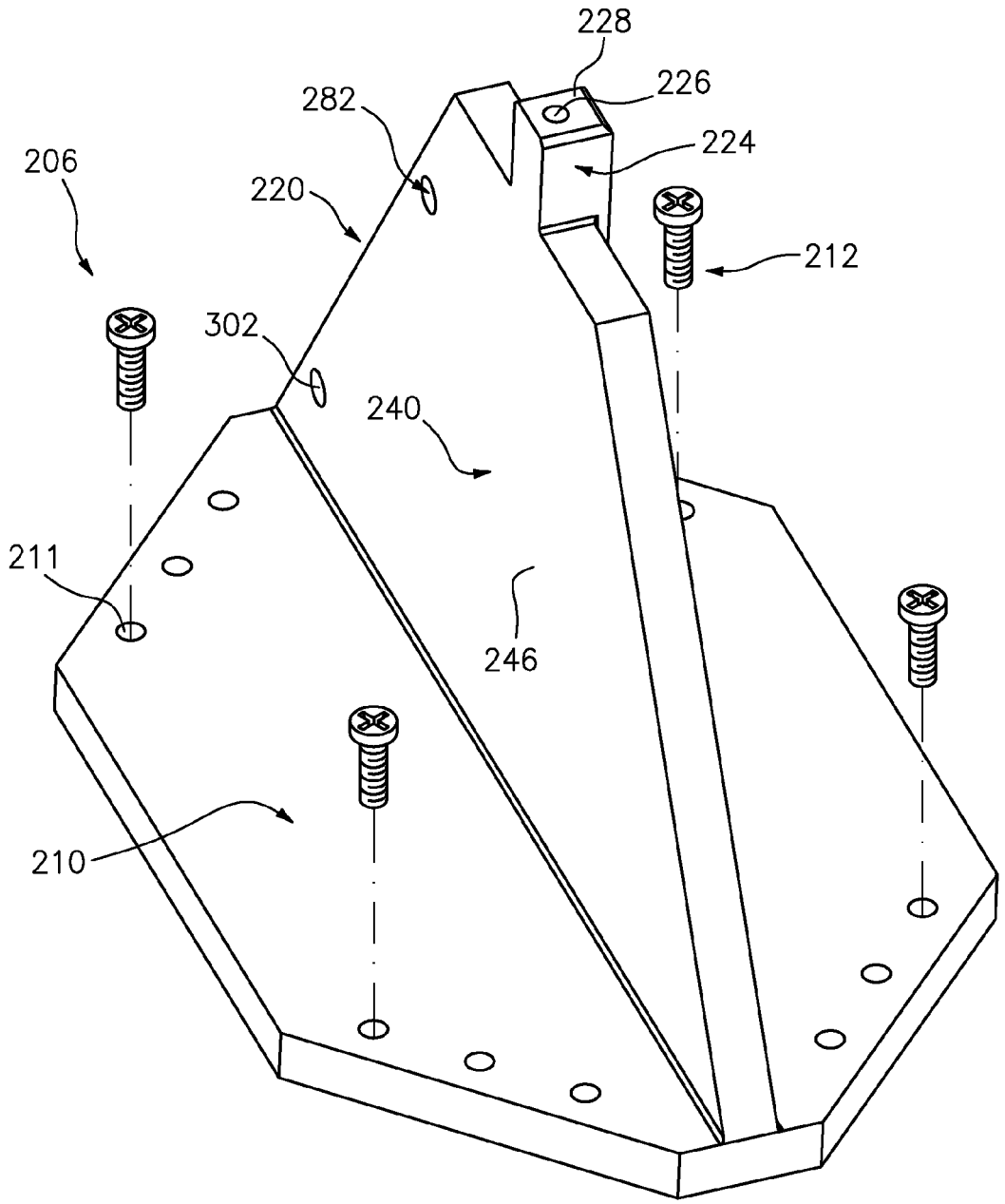
FIG. 8 is an isolated view of a pedestal of the device of FIG. 6A.

In the exemplary implementation, for ease of assembly of the hoop to the pedestals 206, the covers 208 are removable and installable. FIG. 8 shows a pedestal 206 with cover removed. The exemplary pedestal comprises a foot or mounting base 210 for mounting to the base 204 of FIG. 6. The exemplary base 204 is a single plywood or composite base forming a mounting plate to which all the support device bases 210 are secured. The exemplary base 204 may be circular or rectangular in planform. The exemplary device base 210 is formed as a flat plate having a plurality of through-holes for fastening to the base 204 (e.g., via wood screws or other appropriate fasteners 212). The exemplary device pedestal 206 further includes a vertical portion/upright 220 extending upward from the upper surface of the device base 210. The upright 220 includes an attachment feature for mounting the hoop (e.g., supporting and securing the hoop to the upright). The exemplary attachment feature comprises an upwardly protruding boss 224 having a downwardly-directed internally threaded bore/hole 226 through an upper end surface 228 of the boss. The upper end surface 228 may support an adjacent face of one of the flanges of the structural hoop with the threaded hole 226 receiving a fastener (e.g., a bolt/screw 230 (FIG. 6A)) extending through an associated hole of the flange.

In the exemplary implementation, the pedestal 206 is formed of a non-metallic material (e.g., polymeric) by means such as molding or a rapid prototyping/3-D printing. Compared with metals, such materials may be easy and inexpensive to form and may provide advantages of not scuffing the structural hoop substrate or any coatings thereon. In a similar vein, the fastener 230 may be polymeric (e.g., a nylon socket-head cap screw) so as to avoid scratching.

The exemplary upright 220 comprises a generally radial flat web 240 (radial relative to the hoop axis 500) and a transverse buttress 242 (FIG. 6A) along one face of the web. In the exemplary implementation, this is the clockwise-facing face 244 of the web as downwardly viewed with the devices installed. Omitting such a buttress from the opposite face 246 allows the cover to have a greater extent (e.g., as discussed below).

Figure 10:
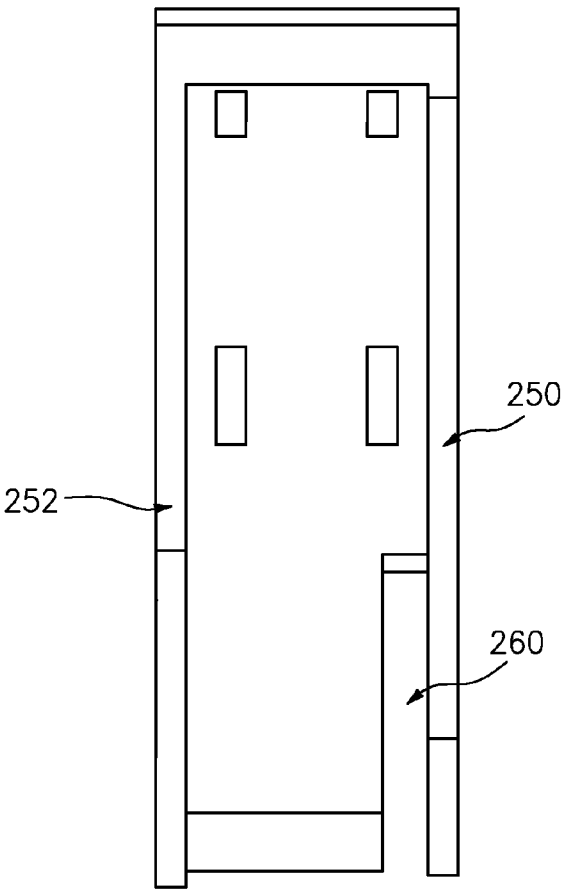
FIG. 10 is an inboard view of the cover of FIG. 9.

The exemplary cover 208 (FIGS. 9 and 10) may be formed by similar materials and similar techniques to the device pedestal 206 and may have a first lateral portion or side plate 250 and an opposite, spaced-apart second lateral portion or side plate 252. A peripheral portion 254 joins the side plates. The exemplary side plates have a perimeter including a segment of a circle with the peripheral portion 254 extending cylindrically along at least portions of that perimeter. In the exemplary installed position, in this particular implementation, an inboard face of the wall 252 abuts the adjacent face 244 of the upright. To accommodate rotation of the cover, the peripheral portion 254 includes a slot 260 alongside the wall 250. The peripheral portion 254 is generally circumferentially co-extensive with the circular perimeter of the wall 250 with the corresponding perimeter of the wall 252 extending further therebeyond to provide greater coverage. The exemplary wall 252 includes a recess 270 eliminating a portion of the circumference and accommodating the structural hoop in at least the installed/closed condition.

To pivotally mount the cover to the pedestal, a pivot 280 (FIG. 6A) may be provided. The exemplary pivot comprises a fastener (e.g., a bolt or socket-head cap screw extending through associated holes (282 (FIG. 8) and 284 (FIG. 9) in the upright web 240 and the plate 250). In one exemplary embodiment, the bolt 280 may pass freely through a hole 282 in the upright and into a threaded hole 284 in the wall 250 with the underside of the head of the bolt engaging the opposite surface/face 246 of the upright. In this particular implementation, a hole 290 (FIG. 6) may be provided in the opposite wall 252 so as to allow easy installation/tightening and loosening/removal of the bolt or the appropriate associated tool. Alternatively, hole 290 may provide access to a nut (not shown) on fastener 280 extending from the opposite side.

Figure 11:
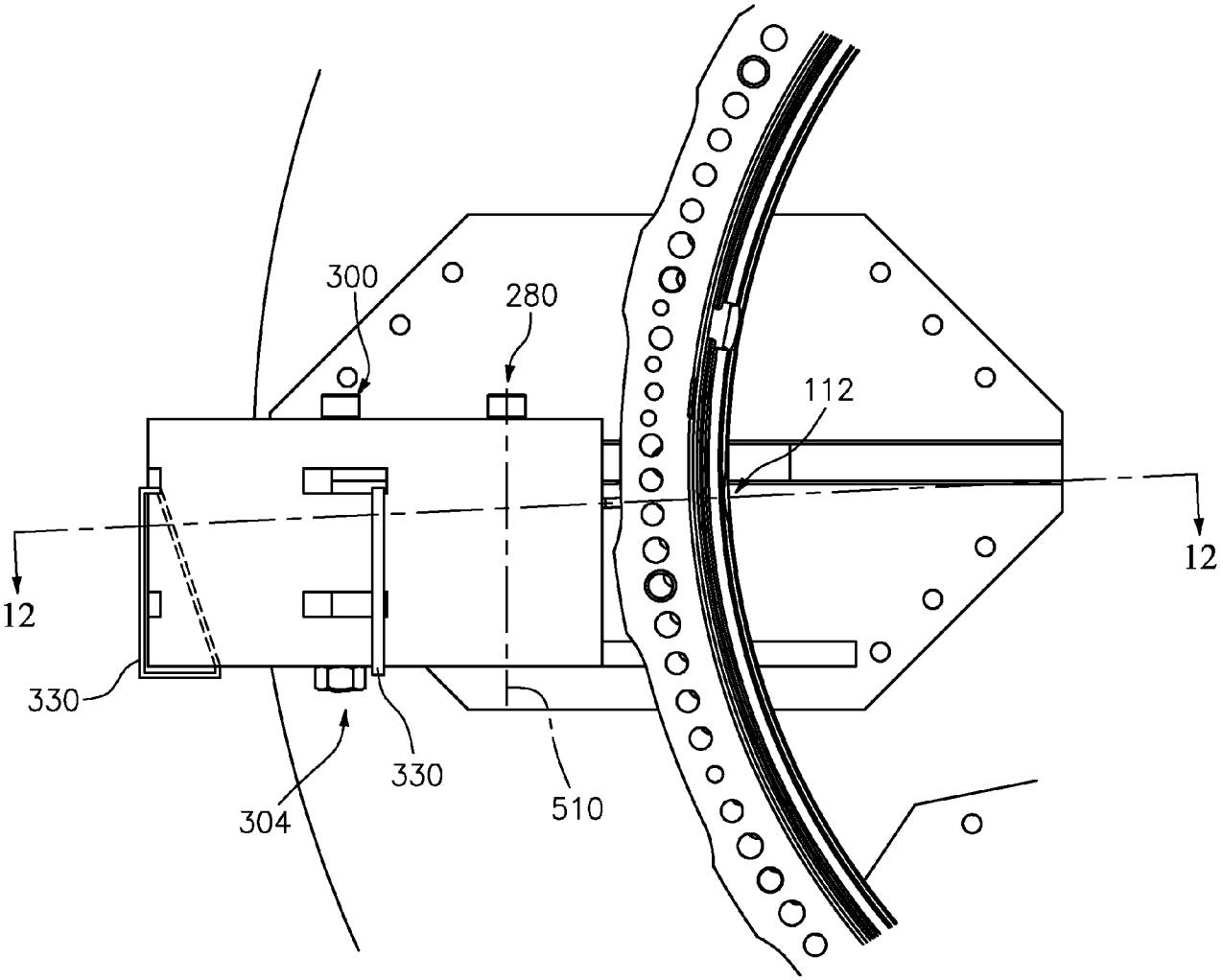
FIG. 11 is an end (top) view of one of the support devices engaging an associated portion of the hoop.
Figure 12:
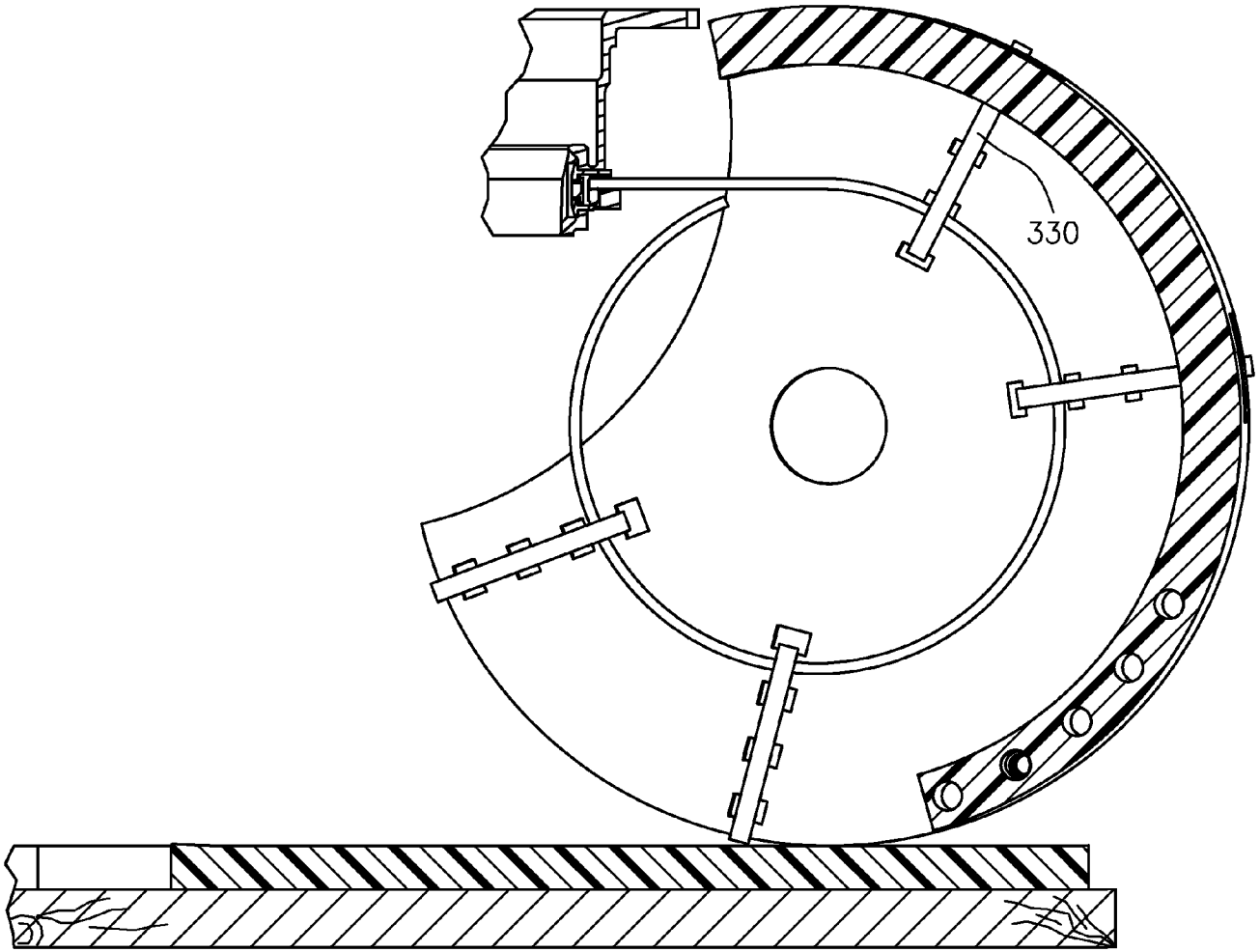
FIG. 12 is a sectional view of the support device taken along line 12-12 of FIG. 11.

In the exemplary device, the cover and/or pedestal comprise means for selectively locking the cover in a plurality of orientations about the pivot axis 510. The exemplary means comprises a pin or other fastener 300 (FIG. 6A) mountable to a corresponding hole in one of the cover and pedestal and selectively engagable to any one of a plurality of holes in the other. For example, there may be a single hole 302 (FIG. 8) in the web 240 of the upright engagable to any one of a circumferential array of holes 310 (FIG. 9) in one or both side walls of the cover. In the exemplary embodiment, both side walls 250,252 of the cover have an evenly spaced circumferential group of such holes 310 (e.g., a group of five being shown in FIG. 9 but alternatives ranging between three and ten). Other locking features may offer near continuous incremental adjustment. Other locking features may provide an actual continuous adjustment. The exemplary pin 300 may be a spring-loaded ball pin or may be a fastener such as a socket head cap screw (and may include a nut 304 (FIG. 11)).

Figure 9:
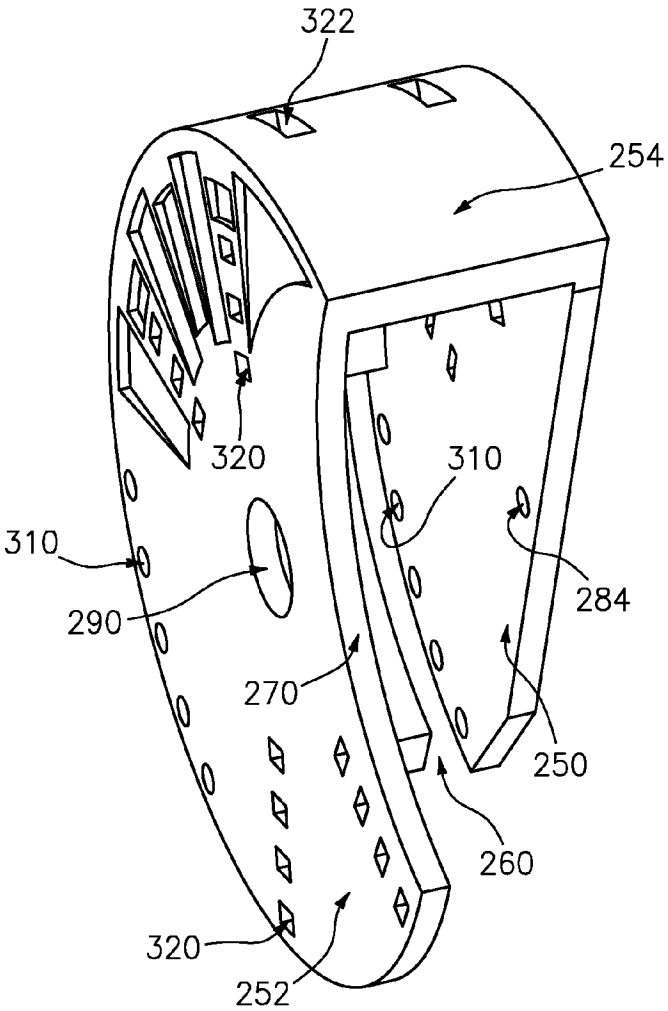
FIG. 9 is an isolated view of the cover of the device of FIG. 6A.

The exemplary cover also includes, along one or both walls 250,252, groups of tie-down holes 320 (FIG. 9). Exemplary tie-down holes 282 are grouped in radial or near-radial groups (e.g., of three to five holes). Similarly, there may be holes 322 at similar circumferential position in the peripheral portion 254. This allows the use of tie-wraps or other fastening devices to extend through combinations of such holes to secure wiring.

In an exemplary sequence of use and operation, the desired number of pedestals (e.g., corresponding to the number of sensors, etc. to be protected) may be positioned on the base 204. This positioning may be in an approximate intended positioning or may be in an actual final positioning pre-fastened to the base. The hoop may be put in place atop the pedestals. In the exemplary implementation, the pedestals are positioned so that their unbuttressed faces 246 fall alongside the sensor (e.g., so that the flange hole to that side of the sensor may used to secure the structural hoop to the pedestal mounting feature 224 via the appropriate fastener 230). These fasteners 230 may be installed and tightened to secure the hoop to the pedestals. If not already fastened, the pedestals may be secured to the base 204. The covers may then be installed to the pedestals (if not already installed). This may initially be to an installed/open (or at least partially open) condition with the slot 260 at least partially receiving the web 240. The pivot bolt 280 may then be installed.

The cover may then be rotated into a more closed condition and locked in place via the pin 300. In certain implementations, the pivot bolt 280 may be yet further tightened to clamp down on the cover to resist rotation about its axis 510. This may help reduce vibration of the cover. The cover mounting and closing step(s) may be repeated for each cover sequentially or the individual steps may be performed for all covers before proceeding to the next step in cover installation. With at least a given cover installed, tie-wraps (zip ties) 330 or like may be used to secure the wiring in place to that cover. This may be through an appropriate combination of the holes

320,322 appropriate for the particular size and positioning of wire bundle therein without straining the lead and braze. Depending on such wiring configuration, a given zip tie may go through both sidewall or just through one wall depending upon the wire dimensions. The lower two groups of the holes 320 appear only on the wall 250. These may be used to secure wires by merely going through two holes in one group or going through one hole in a given group and then around the periphery of the wall. With the hoop so installed, the hoop and device assembly may be inserted into a shipping container (e.g., carton, crate, or the like) for shipping. The combination may be removed from the crate for storage, testing or like with limited risk to the protected sensors. In some of this testing, however, the covers may either be rotated to a more open condition or removed to allow connection of test equipment, if necessary.

The use of "first", "second", and the like in the following claims is for differentiation only and does not necessarily indicate relative or absolute importance or temporal order. Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic hoop configuration, details of such configuration or its associated engine may influence details of particular implementations. Accordingly, other embodiments are within the scope of the following claims.

What is claimed is:

1. A hoop support device (202) for supporting a hoop assembly (100), the hoop assembly comprising a structural hoop (102) and a plurality of wires, the hoop support device comprising:

a pedestal (206) comprising:

a mounting feature (224, 226) for mounting the hoop;

a base (210) having a plurality of mounting holes (211); and a web (240) extending upward from the base and bearing the mounting feature and a feature (282) for said pivotal mounting of the cover; and a cover (208) pivotally mounted to the pedestal for rotation about a pivot axis (510), the cover having at least a lateral portion (250, 252) and a peripheral portion (254) for enclosing at least one said wire in an installed/closed condition.

2. The hoop support device of claim 1 wherein:

the mounting feature comprises:

a distal boss (224); and a threaded hole (226) in the boss.

3. The hoop support device of claim 1 wherein:

the cover and the pedestal are non-metallic.

4. The hoop support device of claim 1 wherein:

the cover comprises:

said lateral portion (250) being a first lateral portion;

a second lateral portion (252); and the peripheral portion (254) joining the first and second lateral portions.

5. The hoop support device of claim 1 wherein:

the cover and/or the pedestal comprises:

means (300, 310) for selectively locking the cover in a plurality of orientations about the pivot axis.

6. A hoop support device (202) in combination with a hoop assembly (100) supported by the hoop support device, wherein:

the hoop assembly comprises:

a structural hoop (102) and a plurality of wires;

the hoop support device comprises:

a pedestal (206) having a mounting feature (224, 226) for mounting the hoop; and a cover (208) pivotally mounted to the pedestal for rotation about a pivot axis (510), the cover having at least a lateral portion (250, 252) and a peripheral portion (254);

the structural hoop is secured at the mounting feature; and the cover covers at least one associated wire of said plurality of wires.

7. The combination of claim 6 wherein:

at least one tie-wrap secures the associated wire to the cover.

8. The combination of claim 6 wherein:

the combination includes a plurality of said hoop support devices.

9. The combination of claim 8 further comprising:

a base (204) to which the pedestals are mounted; and a container containing the base, hoop support devices, and hoop assembly.

10. The combination of claim 6 wherein the hoop assembly comprises:

the structural hoop having:

an inner diameter (ID) band (116);

a rub coating (110) along an inner diameter (ID) face (104) of the ID band;

a plurality of apertures (114) in the ID band; and at least one flange (120) protruding radially outward from the ID band; and a plurality of sensors (112) mounted in respective ones of the apertures; and a plurality of said wires, each respectively associated with an associated said sensor.

11. A method of mounting a hoop assembly to the hoop support device of claim 1, the hoop assembly comprising a structural hoop (102) and a plurality of wires, the method comprising:

mounting the structural hoop to the pedestal of the support device; and rotating the cover to the installed/closed condition to enclose at least one said wire.

12. The method of claim 11 wherein:

the mounting comprises inserting a screw through a hole in the structural hoop and screwing to the pedestal; and the rotating comprises rotating into the installed/closed condition from an installed/open condition and locking.

13. The method of claim 11 wherein:

there are a plurality of said hoop support devices; and for each said hoop support device the method comprises:

mounting the structural hoop; and rotating the cover.

14. The method of claim 11 further comprising:

while the structural hoop is mounted to the pedestal, testing sensors of the hoop assembly.

15. The method of claim 11 further comprising:

while the structural hoop is mounted to the pedestal, placing the hoop in a container and shipping the container.

16. The method of claim 11 wherein the rotating comprises rotating into the installed/closed condition from an installed/open condition and the method further comprises:

rotating the cover back from the installed/closed condition to the installed/open condition; and dismounting the structural hoop from the pedestal.

17. The method of claim 11 further comprising:

installing the cover to the pedestal after the mounting and before the rotating.

18. The method of claim 11 wherein the hoop assembly is a first hoop assembly and the method further comprises:

dismounting the structural hoop from the pedestal; and mounting a structural hoop of a second hoop assembly to the pedestal, the second hoop assembly differing in size from the first hoop assembly.

* * * * *